US006054801A

United States Patent [19]

Hunt et al.

[11] Patent Number: 6,054,801

[45] Date of Patent: Apr. 25, 2000

[54] FIELD EMISSION CATHODE FABRICATED FROM POROUS CARBON FOAM MATERIAL

[75] Inventors: Charles E. Hunt, Davis; Andrei G. Chakhovskoi, Elk Grove, both of Calif.

[73] Assignee: Regents, University of California

[21] Appl. No.: 09/112,080

[22] Filed: Jul. 8, 1998

Related U.S. Application Data

[60] Provisional application No. 60/076,201, Feb. 27, 1998.

[51] Int. Cl.[7] ..... H01J 1/30; H01J 1/13

[52] U.S. Cl. ..... 313/311; 313/346 DC; 313/346 R

[58] Field of Search ..... 313/311, 346 R, 313/346 DC, 310, 352; 257/11; 445/50, 51

[56] References Cited

U.S. PATENT DOCUMENTS

| | | | |
|---|---|---|---|
| 3,922,334 | 11/1975 | Marek et al. . | |
| 4,250,429 | 2/1981 | Lersmacher et al. . | |
| 4,330,387 | 5/1982 | Astruc et al. . | |
| 4,336,124 | 6/1982 | Gerard et al. . | |
| 4,401,519 | 8/1983 | Kadija et al. . | |
| 4,415,835 | 11/1983 | Mishra et al. . | |
| 4,487,589 | 12/1984 | Mishra et al. . | |
| 4,515,672 | 5/1985 | Platek et al. . | |
| 4,673,473 | 6/1987 | Ang et al. | 204/59 R |
| 5,514,488 | 5/1996 | Hake et al. . | |

FOREIGN PATENT DOCUMENTS 9625753 2/1996 WIPO .

OTHER PUBLICATIONS

A. G. Chakhovskoi et al., "Method of Fabrication of Matrix Carbon Fiber Field Emission Cathode Structures for Flat–Panel Indicators," Journal of Vacuum Science and Technology B, 11(2), Mar./Apr. 1993, pp. 511–513.

Y.A. Gregoriev et al., "Experimental Study of Matrix Carbon Field Emission Cathodes and Computer–Aided Design of Electron Guns for Microwave Power Devices, Exploring These Cathodes", 9th International Conference on Vacuum Microelectronics, St. Petersberg, Russia, Jul. 1996, Technical Digest, pp. 522–525.

A. Y. Tcherepanov et al., "Flat Panel Display Prototype Using Low–Voltage Carbon Field Emitters," Journal of Vacuum Science and Technology B, 13(2), Mar./Apr. 1995, pp. 482–486.

Marc S. Litz et al., "Rep–rate Explosive Whisker Emission Cathode Investigations," SPIE Publications vol. 2154, Intense Microwave Pulses II, 1994, pp. 110–117.

Joseph Wang, "Reticulated Vitreous Carbon," Electrochemica Acta, vol. 26 (No. 12), 1981, pp. 1721–1726.

C. B. Collins et al., Amorphic Diamond Films Produced by Laser Ablation, MRS Materials Research Society Symposium Proceedings vol. 285, 1993, pp. 547–555.

Abstract, F. Davanloo et al., "Adhesion Measurements of Noncrystalline Diamond Films Prepared by a Laser Plasma Discharge Source," Journal of Adhesion Science and Technology, vol. 7 (No. 12), 1993, pp. 1323–1324.

Abstract, F. Davanloo et al., "Protective Films of Nanophase Diamond Deposited Directly on Zinc Sulfide in Infrared Optics," Journal of Materials Research, vol. 8 (No. 12), Dec. 1993, pp. 3090–3109.

Abstract, F. Davanloo et al., "Infrared Optical Properties of Pulsed Laser Deposited Carbon Films with the Bonding and Properties of Diamond," Journal of Materials Research, vol. 10 (No. 10), Oct. 1995, pp. 2548–2554.

Abstract, F. Davanloo et al., "Adhesion Properties of Amorphic Diamond Films Deposited on Zinc Sulfide Substrates," Journal of Adhesion Science and Technology, vol. 9 (No. 6), 1995, pp. 681–694.

*Primary Examiner*—Nimeshkumar D. Patel
*Assistant Examiner*—Joseph Williams
*Attorney, Agent, or Firm*—Finley & Berg, L.L.P.

[57] ABSTRACT

A field emission cathode is provided comprising an emissive member formed of a porous foam carbon material. The emissive member has an emissive surface defining a multiplicity of emissive edges.

10 Claims, 1 Drawing Sheet

FIELD EMISSION CATHODE FABRICATED FROM POROUS CARBON FOAM MATERIAL

This application claims the benefit of U.S. Provisional Application No. 60/076,201, filed Feb. 27, 1998.

FIELD OF THE INVENTION

This invention relates generally to field emission cathodes.

BACKGROUND OF THE INVENTION

Electron emission devices are key components of many modern technological products. For example, focused "beams" of electrons produced by such devices are used in X-ray equipment, high-vacuum gauges, televisions, large-area stadium-type displays, and electron beam analytical devices such as scanning electron microscopes.

Standard electron emission devices operate by drawing electrons from a cathode formed from a material that readily releases electrons when stimulated in a known manner. Typically, electrons are drawn from the cathode by the application of either a thermionic stimulus or an electric field to the cathode. Devices operating through application of an electric field are said to operate by field emission. Cathodes used in field emission devices are accordingly known as field emission cathodes, and are considered "cold" cathodes, as they do not require the use of a heat source to operate.

Field emission offers several advantages over thermionic stimulus in many electron emission applications. A field emission device (which creates an electric field) will typically require less power than a thermionic device (which creates a heat source) to produce the same emission current, respectively. Field emission sources are typically on the order of 1000 times brighter than comparable thermionic sources. The added brightness can be highly advantageous in lighting applications, such as stadium displays, or in applications which require the use of electron beams operating at intense focus, such as microscopes.

Further, the heat sources used in thermionic electron emission devices eventually damage them, leading to relatively quick "burnout." In applications requiring the use of many electron emission devices, such as in large area collective usage television screens, use of thermionic emission devices is very expensive because of the need to replace frequently devices suffering from rapid burnout.

Additionally, thermionic electron emission devices are not feasible for some applications. Thermionic devices are temperature dependent, and thus cannot be used in applications operating in extreme temperatures or where the ambient temperature conditions vary substantially over time. For example, thermionic devices will not work properly in motors or engines where temperature conditions may swing from 70° Fahrenheit to −60° Fahrenheit within a few minutes. In contrast, field emission devices, which operate relatively independently from temperature conditions, can be used in such applications. Thermionic devices are also inappropriate for use where the heat used to draw the electron beam may damage the environment within which electron emission is to occur. For example, in X-ray applications focused near a human body, thermionic emission of electrons is undesirable as the heat source applied could cause pain or damage to the subject. Field emission devices avoid these concerns as they apply and generate relatively little heat.

Among various materials known to be suitable for the construction of field emission cathodes, carbon-based materials have proven to be capable of producing significant emission currents over a long lifetime in relatively low-vacuum environments ($10^{-7}$ Torr or less). Cathodes utilizing diamond films, bulk carbon, and graphite have been developed, but have required the application of substantial voltages to the cathode before generating significant electron emission. Other cathodes having regular, defined surface structures created from carbon materials include cathodes constructed from individual carbon fibers bundled together, cathodes machined from carbon rods, and matrix cathodes with carbon surfaces formed by photolithography and thermochemical etching procedures. While these cathodes can produce high current density upon application of low voltages, they are expensive to produce, as they require sophisticated fabrication procedures and/or manual assembly in their production.

It is an object of the current invention to provide an efficient and durable field emission cathode which may be manufactured simply and inexpensively.

Another object of the current invention is to provide a field emission cathode comprising an emissive member formed of a porous carbon foam material having an emissive surface which defines a multiplicity of emissive edges.

Other objects and advantages of the current invention will become apparent when the field emission cathode of the present invention is considered in conjunction with the accompanying drawings, specification, and claims.

SUMMARY OF THE INVENTION

A field emission cathode is provided comprising an emissive member formed of a porous carbon foam material. The emissive member has an emissive surface defining a multiplicity of emissive edges.

DESCRIPTION OF THE PREFERRED EMBODIMENT

Figure 1:
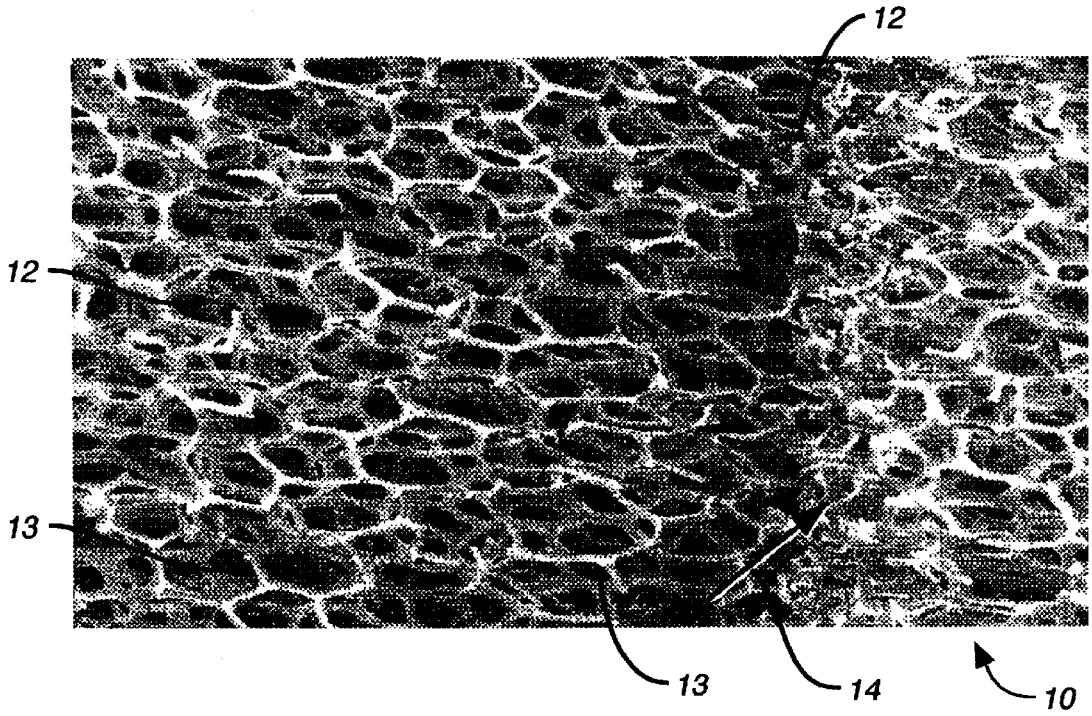
FIG. 1 shows a scanning electron microscope's microphotograph of an emissive member of the present invention formed of Reticulated Vitreous Carbon™ and having a cut vertical edge.

FIG. 1 illustrates a porous carbon foam material 10 used to form the emissive member of the inventive field-emission cathode. The member microphotographed is formed from Reticulated Vitreous Carbon™ ("RVC"). RVC forms vitreous (glassy) carbon into an open cell, reticulated structure having a random pore structure with good uniform pore distribution statistically. Typical characteristics of currently available porous carbon foam materials are listed in Table I.

TABLE I

Characteristics of Currently Available Porous Carbon Foam Materials

| Important Physical Characteristics | Typical Range of Values |
|---|---|
| Porosity Grade | 10 to 100 pores per inch (ppi) with a potentia1 additional compression by a factor of 10 |
| High Surface Area | Up to 66 $cm^2/cm^3$ for 100 ppi |
| High Void Volume | 90–97% for different porosity grades |
| Compressive Strength | 40–170 psi (higher for compressed materials) |
| Tensile Strength | 25–150 psi (higher for compressed materials) |
| Hardness | 6–7 Mohs |
| Specific Resistivity | 0.18–0.27 Ohm-in (0.47–0.69 Ohm-cm) |

The emissive member of the inventive cathode is prepared by forming the porous carbon foam material into an emissive surface defining a multiplicity of emissive edges. The emissive edges constitute the broken edges 12 of individual pore structures 13 at the surface of the carbon material. These edges 12 can be produced in the emissive member according to various methods, including but not limited to conventional sawing and drilling of the carbon foam material, or precision milling techniques. Machine processing of the porous carbon foam material is preferred, as it forms well defined hard and sharp edges within the three-dimensional emissive member structure. The carbon foam material can be machined into the cathode's desired shape concurrently with the formation of the emissive surface. FIG. 1 shows RVC material cut to form a three dimensional surface structure with a vertical edge 14.

In operation, electrons are drawn from the emissive edges 12 of the carbon foam material upon the application of an electric field to the cathode. As the carbon foam material is porous, and does not have a continuous surface, each edge 12 is separate from each other edge 12, and an electric field applied to the carbon foam material will be enhanced about each edge 12, causing electron emission from the carbon material at the edge 12. By taking advantage of the random pore distribution of the porous carbon foam material, the invention avoids the labor and expense required to fabricate defined emission points on the cathode surface, while creating a carbon-based field emission cathode which operates well at low voltages and in low vacuum environments ($10^{-7}$ Torr or less). RVC cathodes have been tested successfully in vacuum environments as low as $10^{-6}$ Torr.

The inventive cathode provides long-term stability in emission because of its use of large numbers of randomly distributed pore edges on the cathode's emissive surface. Cathodes employing defined emission tips carefully formed in regular patterns typically do not utilize extremely large numbers of emission tips, and can be devastated by the destruction of a few key emission sites. In contrast, as the inventive cathode forms vast numbers of emissive edges, the loss of a few emissive edges will have negligible impact upon the produced emission current. Further, in the inventive cathode, destruction of an emissive edge frequently will create a new pore edge which will operate in place of the destroyed edge.

The current density available from the cathode can be controlled by changing the number of the emissive edges. This can be accomplished by varying the porosity of the carbon foam material: higher porosity grade materials will feature more pores 13 per inch ("ppi") and accordingly more edges 12 over the same surface area. Accordingly, the porosity of the carbon foam material used should be chosen according to the level of emission current density desired for the application in which the field emission device employing the inventive cathode is used. Lower limits on the porosity of the material are dictated essentially by the dropoff in the number of emission sites as the pore size of the material increases. Suitable porosities for RVC materials of the invention are equal to or greater than 50 ppi. Upper limits on the porosity of the material are governed by a current crowding effect: if the emissive edges of the emissive surface are too close to each other, the electrons will not release from each emissive edge, but will instead gather at a few emission sites, lowering the number of effective emissive edges and lowering the level of emission current density. RVC samples having a raw porosity of 100 ppi and undergoing 2×, 3×, 5×, and 10×compression have produced successful results in field emission applications in testing.

The shape of the emissive member of the cathode can also be chosen to meet the requirements of the desired application in which it is used. Shapes having a large, flat emissive area from which a substantial emission current can be drawn will be suitable for many applications, such as lighting displays. Appropriate shapes for the inventive cathode include, but are not limited to, discs, cubes, cylinders, rods, and parallelepipeds.

RVC is a preferred porous carbon foam material due to characteristics it possesses which are desirable in field emission. RVC has a high void volume (up to 97%) and large surface area (up to 66 $cm^2/cm^3$ for 100 ppi) which creates a large number of emissive edges on its emissive surface. Further, RVC features a highly uniform micromorphology. As a glassy material, RVC has greater internal uniformity of its pore structures than do natural graphites. Accordingly, emission current drawn from an RVC emission surface has a more uniform distribution than would a natural graphite material.

RVC is also characterized by exceptional chemical inertness and oxidation resistance. These properties reduce the hazard of chemical reactions between ions or molecules of residual gases with the cathode surface, which can be a critical factor when the field emission cathode is used in modest vacuum environments. RVC's hardness, rigid volume structure, and high compression strength provide durability and allow the material to be easily machined to desired shapes. Its high tensile strength resists ponderomotive forces created by strong electric fields which act to apply pulling action to the cathode structure and create tension in the material. Further, RVC has a fairly high resistivity for a carbon material (0.18–0.27 Ohm-in for RVC as compared to 0.001–0.002 Ohm-in for solid vitreous carbon), which limits localized currents and thus reduces the probability that surface arc currents will form. This increases the lifetime of the cathode.

RVC typically is formed by high-temperature pyrolysis under a controlled atmosphere from a raw polymeric resin. RVC is presently commercially available from Energy Research and Generation, Inc. ("ERG") of Oakland, Calif. Destech Corporation of Tucson, Ariz. also sells an open-celled glassy carbon foam.

It should be understood, however, that the porous carbon foam material used to form the inventive cathode need not be RVC or be manufactured according to any specific method. The invention is directed toward using the surface morphology of a porous carbon material to form a large number of edges acting as individual emission sites. The material should have a sufficiently low porosity such that current crowding does not occur, but a sufficiently high porosity such that a significant emission current is reliably produced by the cathode. The inertness and oxidation resistance of the material should be adequate to prevent chemical reaction hazards. The material should be durable and should have sufficient tensile strength to resist ponderomotive forces created within the cathode structure. Its resistivity should be high enough that significant surface arc currents will not form during operation of the field emission device in which the cathode is used. The inventive cathode can use any porous carbon foam material, produced according to any method, that has the characteristics described above.

Figure 2:
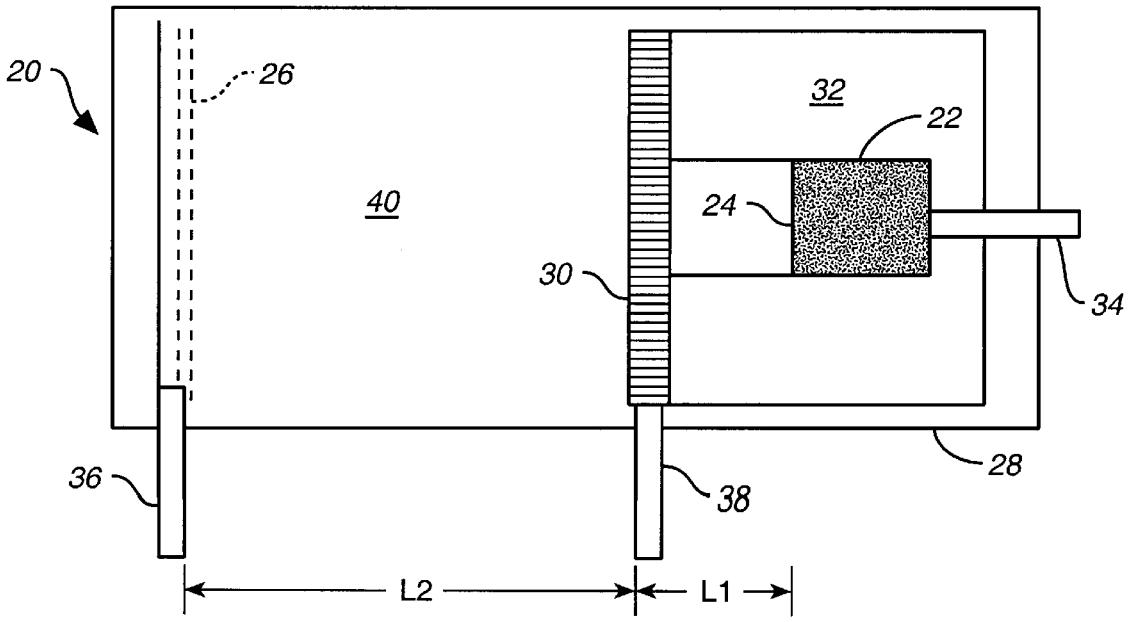
FIG. 2 shows an embodiment of a field emission device utilizing the inventive cathode.

The inventive cathode can be used in any field emission device application. FIG. 2 depicts an example of a simple field emission device 20 in which the inventive cathode could be used. An inventive cathode 22, having emissive surface 24, and anode 26 are enclosed within a vacuum envelope 28 operating at a sufficiently high vacuum that avoids undesirable chemical reactions with residual gases upon stimulation of electron emission. A gate 30 is positioned between cathode 22 and anode 26 such that the emissive surface 24 of cathode 22 is separated from gate 30 by a distance L1, and gate 30 is separated from anode 26 by a distance L2. Cathode 22 is preferably set within an insulating member 32 such that insulating member 32 does not obstruct paths between emissive surface 24 and gate 30. Insulating member 32 acts to electrically isolate gate 30 from cathode 22 while assembling gate 30 and cathode 22 into one structure, assuring maintenance of the proper distance L1. A cathode contact 34, anode contact 36, and gate contact 38 are positioned in contact with cathode 22, anode 26, and gate 30, respectively, and extend through vacuum envelope 28 such that voltage differentials can be applied between cathode 22, anode 26, and gate 30 by connecting a means for creating a voltage differential (not shown) across the contacts.

In operation, a first voltage differential is applied between cathode 22 and anode 26, creating an electric field between cathode 22 and anode 26 which tends to pull electrons from the surface of cathode 22 and towards anode 26 through vacuum environment 40, but produces insignificant emission current when applied independently. When emission is desired, a second voltage differential of the same polarity as the first voltage differential is applied between cathode 22 and gate 30, enhancing the electric field sufficiently to produce the desired emission current. Use of gate 30 in this manner is desirable as the level of emission current produced by field emission device 20 can be controlled by altering the second voltage differential in small increments. Both voltage differentials may be created by grounding cathode 22 and applying positive voltages to gate 30 and anode 26, but it should be understood that other means of creating both voltage differentials may be employed. Distances L1 and L2 and the first and second voltage differentials should be chosen to meet the requirements of the specific application to which the field emission device 20 is oriented while producing the emission effects described above.

The simple field emission device 20 described above is configured suitably to act as a cathodoluminescent light source and can be constructed from materials typically used in cathode ray tube type devices. For example, vacuum envelope 28 may be a glass envelope, while gate 30 may be a mesh hanging on a frame supported by ceramic insulators 32. Materials suitable for constructing gate 30 include, but are not limited to low vapor pressure refractory metals such as platinum, gold, molybdenum, nickel, or nichrome, and conductive non-metals such as carbon mesh.

It should be understood that the inventive cathode can be used in a wide variety of field emission applications and its use is not limited to field emission device 20. Potential applications in which the inventive cathode could be used include, but are not limited to, large area stadium-type displays, X-ray sources (which could potentially be used in vitro), high-vacuum gauges, flat panel displays, digital or pictorial indicators, backlights for LCD displays, UHV devices such as clystrodes or magnetrons, analytical tools such as scanning electron microscopes, and microfabrication tools such as electron beam evaporators or heaters.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A field emission cathode, comprising:

an emissive member formed of a porous carbon foam material, said emissive member having an emissive surface defining a multiplicity of emissive edges.

2. The field emission cathode of claim 1 wherein said emissive member contains a multiplicity of pores, said emissive edges projecting from said pores at said emissive surface.

3. The field emission cathode of claim 2 wherein said porous foam carbon material has a porosity, said porosity greater than or equal to 50 pores per inch.

4. The field emission cathode of claim 3 wherein said porosity of said porous carbon foam material is less than or equal to 1000 pores per inch.

5. The field emission cathode of claim 4 wherein said porous carbon foam material has a void volume in the range of between 90 and 97 percent.

6. The field emission cathode of claim 5 wherein said porous carbon foam material has a compressive strength of at least forty pounds per square inch.

7. The field emission cathode of claim 6 wherein said porous carbon foam material has a tensile strength of at least 25 pounds per square inch.

8. The field emission cathode of claim 7 wherein said porous carbon foam material has a hardness of at least six Mohs.

9. The field emission cathode of claim 8 wherein said porous carbon foam material has a specific resistivity in the range of between 0.18 and 0.27 Ohms per square inch.

10. A field emission device, comprising:

a cathode formed of a porous carbon foam material, said cathode having an emissive surface defining a multiplicity of emissive edges;

an anode;

a vacuum environment enclosing said cathode and said anode; and means for maintaining said cathode and said anode at a voltage differential such that a plurality of electrons are emitted from said emissive edges of said cathode towards said anode.

* * * * *